US009895702B2

(12) United States Patent
Lei

(10) Patent No.: US 9,895,702 B2
(45) Date of Patent: Feb. 20, 2018

(54) SINGLE PUSHBUTTON DEVICE FOR SWITCHING TO OUTPUT WATER WITH MULTIPLE SPRAY PATTERNS

(71) Applicant: Xiamen Runner Industrial Corporation, Xiamen (CN)

(72) Inventor: Zheng-zhen Lei, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 98 days.

(21) Appl. No.: 15/220,213

(22) Filed: Jul. 26, 2016

(65) Prior Publication Data

US 2017/0056896 A1 Mar. 2, 2017

(30) Foreign Application Priority Data

Aug. 31, 2015 (CN) ..... 2015 2 0661026 U

(51) Int. Cl.

| | |
|---|---|
| ***B05B 1/18*** | (2006.01) |
| ***B05B 1/12*** | (2006.01) |
| ***B05B 1/16*** | (2006.01) |
| ***B05B 1/30*** | (2006.01) |
| ***B05B 12/00*** | (2018.01) |
| ***E03C 1/04*** | (2006.01) |
| ***E03C 1/084*** | (2006.01) |

(52) U.S. Cl.

CPC ..... *B05B 1/12* (2013.01); *B05B 1/1609* (2013.01); *B05B 1/169* (2013.01); *B05B 1/1636* (2013.01); *B05B 1/3013* (2013.01); *B05B 12/002* (2013.01); *E03C 1/0405* (2013.01); *E03C 1/084* (2013.01); *B05B 1/18* (2013.01); *B05B 1/185* (2013.01)

(58) Field of Classification Search

CPC ..... B05B 1/18; B05B 1/185; B05B 1/3013; B05B 1/12; B05B 1/1609; B05B 1/1636; B05B 1/169; E03C 1/0405; E03C 1/084

USPC ..... 239/44–446

See application file for complete search history.

(56) References Cited

U.S. PATENT DOCUMENTS

| | | | | | |
|---|---|---|---|---|---|
| 4,629,124 | A * | 12/1986 | Gruber | B05B 1/1618 | 239/428.5 |
| 5,143,295 | A * | 9/1992 | Okayama | B05B 1/34 | 239/403 |
| 5,433,384 | A * | 7/1995 | Chan | B05B 1/1636 | 239/239 |
| 6,370,713 | B2 * | 4/2002 | Bosio | B05B 1/1618 | 239/441 |

(Continued)

*Primary Examiner* — Arthur O Hall
*Assistant Examiner* — Joseph A Greenlund
(74) *Attorney, Agent, or Firm* — Chun-Ming Shih

(57) ABSTRACT

A single pushbutton device includes a housing, a bushing, a water channel assembly, and a rotary assembly. The bushing and the rotary assembly are mounted inside of the housing, the water channel assembly is mounted around of the rotary assembly, and a button is through a hole of the housing. When push down the button, a rotary sleeve of the rotary assembly is rotated, a bump of the rotary sleeve is rotated along multiple noses of the multiple abutting inserts of the water channel assembly to sequentially press down the abutting inserts, further open different waterways, and output water with different spray or bubbling forms. Given the foregoing structure, the single pushbutton device is compact, facilitates quick and convenient operation, and requires less force exerted thereon for operation.

5 Claims, 10 Drawing Sheets

(56) References Cited

U.S. PATENT DOCUMENTS

| | | | | |
|---|---|---|---|---|
| 6,471,145 | B1 * | 10/2002 | Huang | B05B 1/3026 239/525 |
| 7,331,536 | B1 * | 2/2008 | Zhen | B05B 1/1618 137/625.48 |
| 7,494,074 | B2 * | 2/2009 | Benstead | B05B 1/1618 239/11 |
| 7,909,269 | B2 * | 3/2011 | Erickson | B05B 1/1618 137/801 |
| 8,313,049 | B2 * | 11/2012 | Xu | B05B 1/18 239/280 |
| 8,448,667 | B2 * | 5/2013 | Meehan | E03C 1/0404 137/637.1 |
| 8,573,512 | B2 * | 11/2013 | Hu | B05B 1/1663 239/443 |
| 8,640,973 | B2 * | 2/2014 | Gansebom | B05B 1/1654 239/390 |
| 8,695,897 | B2 * | 4/2014 | Engel | B05B 1/185 239/393 |
| 8,925,583 | B2 * | 1/2015 | Zhou | B05B 1/1636 137/625.11 |
| 9,175,459 | B2 * | 11/2015 | Zhang | B05B 1/1618 |
| 9,449,859 | B2 * | 9/2016 | Song | C23C 16/45565 |
| 9,512,602 | B2 * | 12/2016 | Lei | E03C 1/08 |
| 9,545,639 | B2 * | 1/2017 | Meehan | B05B 1/1627 |
| 9,776,196 | B2 * | 10/2017 | Yu | B05B 1/1636 |
| 9,795,974 | B2 * | 10/2017 | Zhou | B05B 1/169 |
| 2001/0008256 | A1 * | 7/2001 | Marsh | B05B 1/1645 239/381 |
| 2011/0042492 | A1 * | 2/2011 | Pan | B05B 1/3013 239/589 |
| 2016/0325291 | A1 * | 11/2016 | Zhou | B05B 1/18 |

* cited by examiner

SINGLE PUSHBUTTON DEVICE FOR SWITCHING TO OUTPUT WATER WITH MULTIPLE SPRAY PATTERNS

BACKGROUND OF THE INVENTION

Field of the Invention

The present invention relates a to a single button device and, more particularly, to a single pushbutton device for switching to output water with multiple spray patterns.

Description of the Related Art

Currently, water output devices may adopt a single pushbutton device with a single water output and a multi-functional pushbutton device with multiple water outputs. However, the multi-functional pushbutton device is disadvantageous in complicated structure, high force exertion in operation, and poor operational stability and thus fails to provide convenient and comfortable experience in the use thereof.

SUMMARY OF THE INVENTION

In view of the problems and drawbacks of the prior art, the objective of the present invention is to provides a single pushbutton device for switching to output water with multiple spray forms being compact in size and facilitating convenient and quick operation with less force required upon operation.

To achieve the foregoing objective, a single pushbutton device for switching to output water with multiple spray patterns includes a housing, a bushing, a water channel assembly, a rotary assembly and a button.

The housing is tubular and has a front end, a rear end and a hole formed through a peripheral wall of the housing.

The bushing is mounted inside the top end of the housing with a bubbler mounted inside the bushing.

The water channel assembly includes a water tube, multiple abutting inserts and multiple first springs.

The water tube has a front portion, a rear portion and multiple recesses.

The front portion is connected with the bushing.

The multiple recesses are formed in the water tube and are located around the water tube.

The multiple abutting insert are mounted and are movable in the recesses of the water tube. Each abutting insert has a nose formed on a top thereof.

Each first spring is mounted between the a corresponding abutting insert and the water tube.

The rotary assembly is mounted around the water channel assembly and has a rotary sleeve, a ratchet and a pressing frame.

The rotary sleeve has a front end, a rear end, and a bump. The bump is formed on an inner wall of the rotary sleeve.

The ratchet is mounted on the rear end of the rotary sleeve. The rear portion of the water tube is connected with the ratchet.

The pressing frame is mounted through the ratchet, is mounted inside the housing, and has a projected portion formed on a top portion of the pressing frame.

The button is mounted through the hole of the housing and is mounted on the projected portion of the pressing frame.

When push down the button, the rotary sleeve of the rotary assembly is rotated, the bump of the rotary sleeve is rotated along multiple noses of the multiple abutting inserts of the water channel assembly to sequentially press down the abutting inserts, further open different waterways, and output water with different spray. The single pushbutton device ensures to be compact, facilitates quick and convenient operation, and requires less force exerted thereon for operation When compared to conventional techniques, the present invention has the following advantages, small size, simple structure, convenient operation, and have multiple water output functions.

BRIEF DESCRIPTION OF THE DRAWINGS

The detailed description of the drawings particularly refers to the accompanying figures in which.

DETAILED DESCRIPTION OF THE INVENTION

The purpose, construction, features, functions and advantages of the present invention can be appreciated and understood more thoroughly through the following detailed description with reference to the attached drawings.

Figure 1:
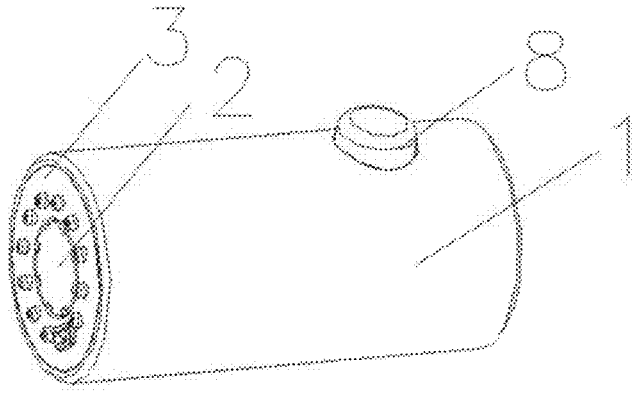
FIG. 1 is a perspective view of a single pushbutton device for switching to output water with multiple spray patterns in accordance with the present invention.
Figure 2:
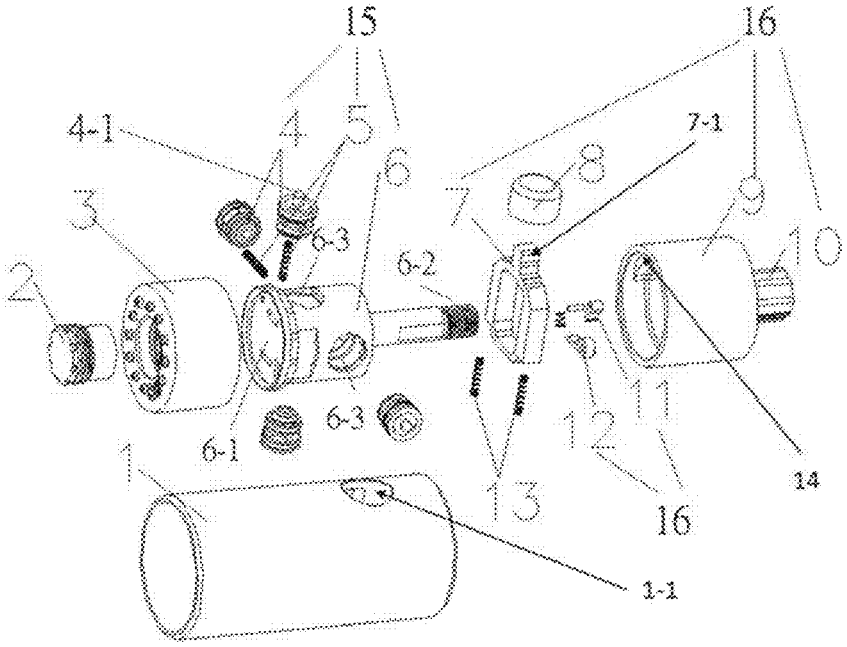
FIG. 2 is an exploded perspective view of the single pushbutton device in FIG. 1.
Figure 3:
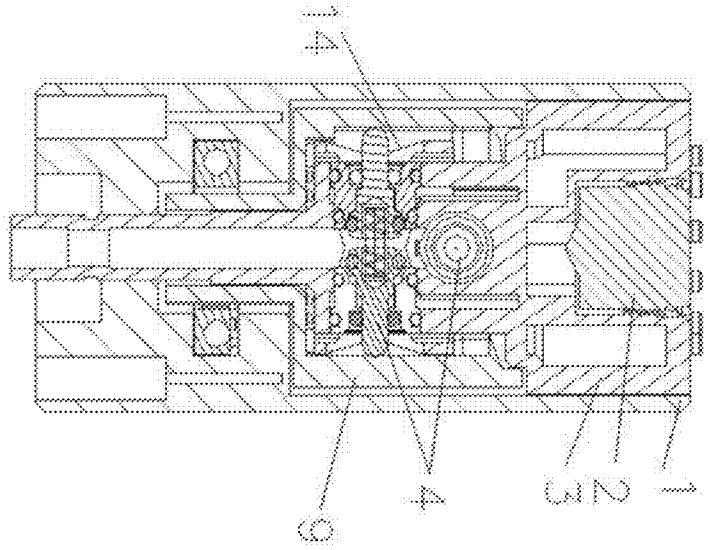
FIG. 3 is a cross-sectional view of the single pushbutton device in FIG. 1.
Figure 4:
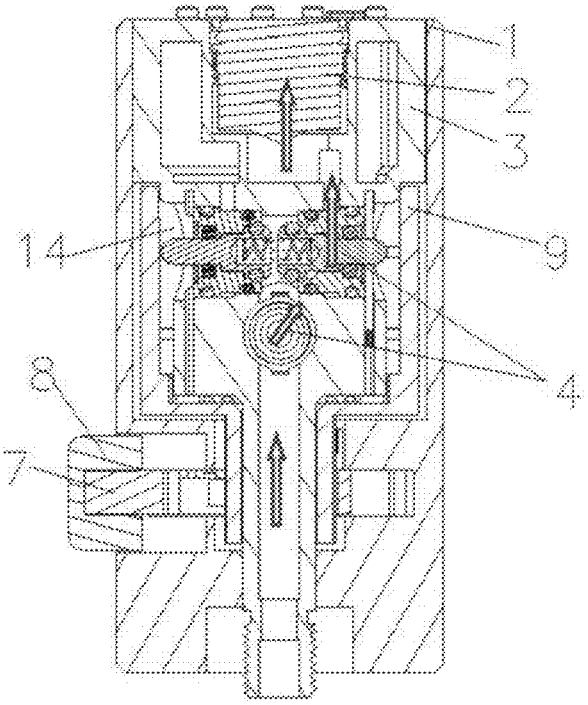
FIG. 4 is an operational cross-sectional view of the single pushbutton device in FIG. 1.
Figure 5:
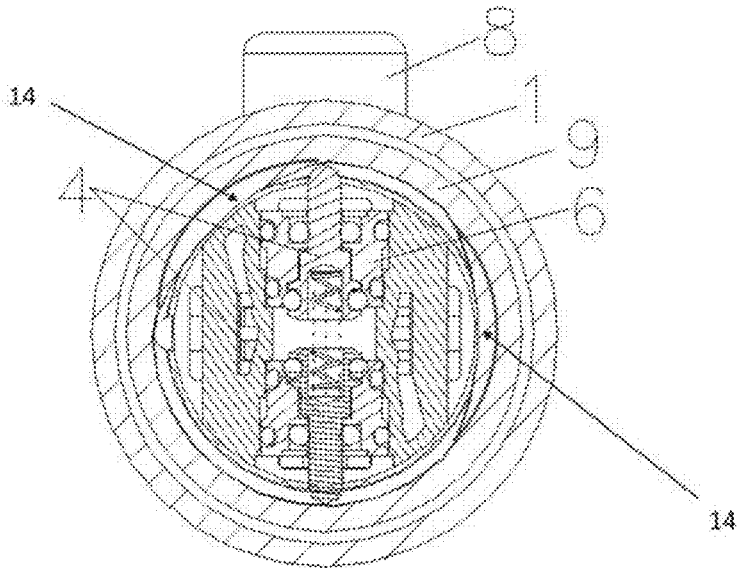
FIG. 5 is a cross-sectional view of the single pushbutton device in FIG. 1 showing one water channel of the single pushbutton device.
Figure 6:
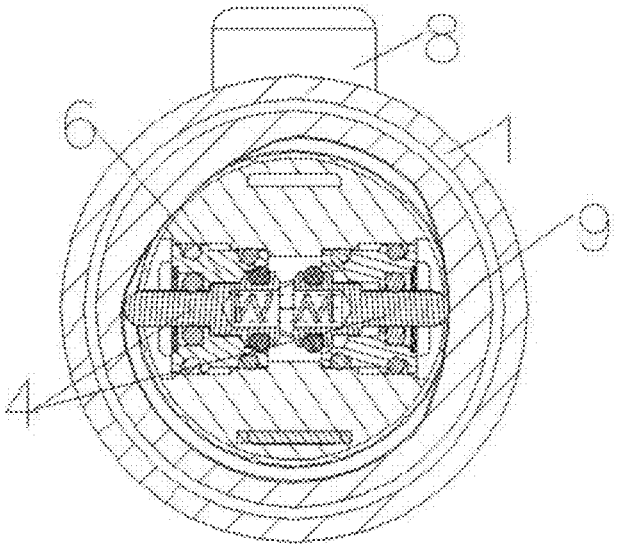
FIG. 6 is a cross-sectional view of the single pushbutton device in FIG. 1 showing another water channel of the single pushbutton device.
Figure 7:
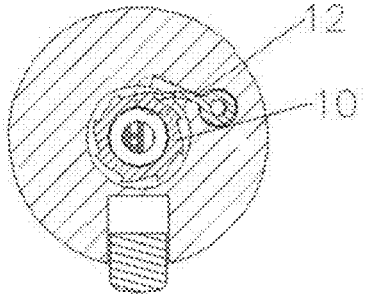
FIG. 7 is a cross-sectional view of a stop pawl of the single pushbutton device in FIG. 1.
Figure 8:
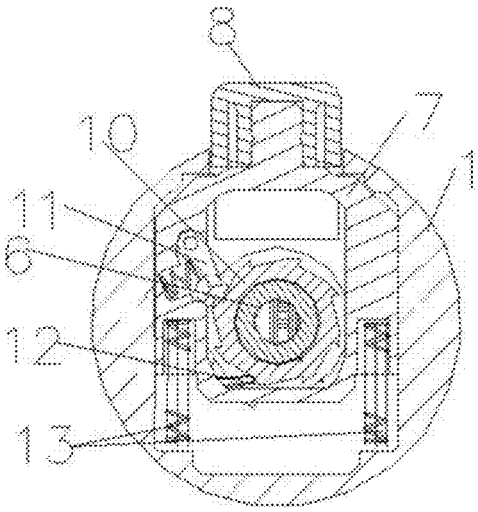
FIG. 8 is a cross-sectional view of the single pushbutton device in FIG. 1 when the single pushbutton device is not operated.
Figure 9:
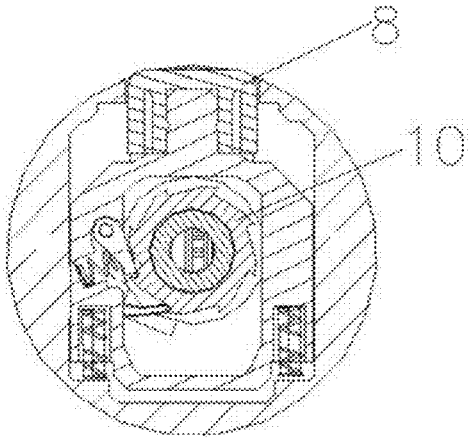
FIG. 9 is a cross-sectional view of the single pushbutton device in FIG. 1 when the single pushbutton device is pressed down.
Figure 10:
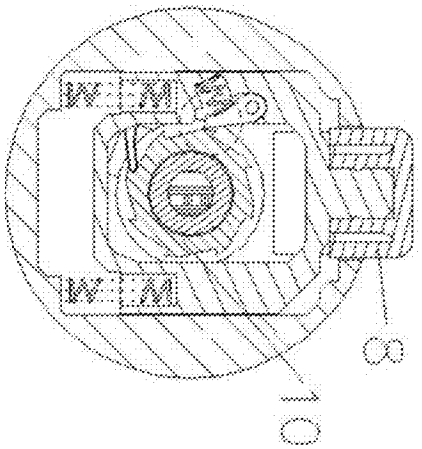
FIG. 10 is a cross-sectional view of the single pushbutton device in FIG. 1 when the single pushbutton device is restoring without force exerted thereon.

With reference to FIGS. 1 and 6, a single pushbutton device for outputting water with multiple spray patterns in accordance with present invention includes a housing 1, a bubbler 2, a bushing 3, a water channel assembly 15, a rotary assembly 16, and a button 8.

The housing 1 is tubular and has a front end, a rear end and a hole 1-1. The hole 1-1 is formed through a peripheral wall of the housing 1. The button 8 is mounted through the hole 1-1 of the housing 1 and protrudes beyond the hole 1-1. The button 8 controls the rotary assembly 16 to rotate to adjust the water channel assembly 15.

The bushing 3 is mounted inside the front end of the housing 1, and the bubbler 2 is centrally mounted inside of the bushing 3. The bushing 3 has multiple waterways formed through the bushing 3 and outputting water with multiple spray forms.

The water channel assembly 15 includes multiple abutting inserts 4, multiple first spring 5 and a water tube 6. The water tube 6 has a front portion 6-1, a rear portion 6-2 and multiple recesses 6-3. The front portion 6-1 of the water tube 6 is connected with the bushing 3. The recesses are formed in the water tube 6, are located around the water tube 6, and communicate with corresponding waterways of the bushing 3. The water channel assembly 15 is collaborated with the bushing 3 to output water with multiple spray patterns through the corresponding waterways of the bushing 3. The abutting inserts 4 are mounted and are movable in the respective recesses of the water tube 6. Each first spring 5 is mounted between a corresponding abutting insert 4 and the water tube 6. Each abutting insert 4 has a nose 4-1 formed on a top of the abutting insert.

The rotary assembly 16 is mounted around the water tube 6 and includes a pressing frame 7, a rotary sleeve 9, a ratchet 10, a driving pawl 11 and a stop pawl 12. The rotary sleeve 9 has a front end and a rear end, and the ratchet 10 is mounted on the rear end of the rotary sleeve 9. The water channel assembly 15 is mounted inside of the rotary sleeve 9, and the rear portion 6-2 of the water tube 6 is connected with the ratchet 10. The rotary sleeve 9 has a bump 14 formed on an inner wall of the rotary sleeve 9 and selectively connected with the noses 4-1 of the abutting inserts 4. The pressing frame 7 is mounted around the ratchet 10, is mounted inside the housing 1, and has a projected portion 7-1 formed on a top portion of the pressing frame 7. The driving pawl 11 is mounted between the pressing frame 7 and the ratchet 10. Multiple second springs 13 are mounted between the pressing frame 7 and the housing 1. The stop pawl 12 is mounted between the ratchet 10 and the housing 1.

The button 8 is mounted through the hole 1-1 of the housing 1 and is mounted on the projected portion 7-1.

With reference to FIGS. 7 to 10, before the button 8 is pressed, the stop pawl 12 engages an initial tooth of the ratchet 10. When the button 8 is pushed down, the button 8 presses down the pressing frame 7, the pressing frame 7 further presses the second spring 13 and drives the driving pawl 11, the driving pawl 11 then drives the ratchet 10 to rotate, such that the stop pawl 12 engages a tooth of the ratchet 10 next to the initial tooth. When the button 8 is released, the restoring elastic force of the second spring 13 pushes the driving pawl 11 back to its original position.

As the pressing frame 7 is reciprocally moved inside of the housing 1 by the force exerted on the pressing frame 7 and the restoring elastic force of the second spring 13, when the ratchet 10 is moved and the stop pawl 12 engages a next tooth of the ratchet 10, the forces exerted on the pressing frame 7 can be balanced by the restoring elastic force in return, thereby causing no discomfort to user's hand upon pressing the button 8 because of unilateral force application.

After the button 8 is pushed down, the rotary sleeve 9 is rotated. Thus, the bump 14 is rotated with the rotary sleeve 9 and the bump 14 is rotated along the noses 4-1 of the abutting inserts 4. Only one of the abutting inserts 4 is pressed down by the bump 14 at a time for water to flow into a corresponding recess of the water tube 6 uncovered by the abutting insert 4 and flow out through different waterways of the bushing 3 to provide multiple water outputs and bubbling functions.

What is claimed is:

1. A single pushbutton device for switching to output water with multiple spray patterns comprising:

a housing being tubular and having a front end, a rear end and a hole formed through a peripheral wall of the housing;

a bushing mounted inside the top end of the housing with a bubbler mounted inside the bushing;

a water channel assembly including: a water tube having:

a front portion connected with the bushing; a rear portion; and multiple recesses formed in the water tube and located around the water tube;

multiple abutting inserts respectively mounted and being movable in the recesses of the water tube, each abutting insert having a nose formed on a top thereof; and multiple first springs, each first spring mounted between a corresponding abutting insert and the water tube;

a rotary assembly mounted around the water channel assembly and having:

a rotary sleeve having a front end, a rear end, and a bump formed on an inner wall of the rotary sleeve;

a ratchet mounted on the rear end of the rotary sleeve, wherein the rear portion of the water tube is connected with the ratchet; and a pressing frame mounted through the ratchet, mounted inside the housing, and having a projected portion formed on a top portion of the pressing frame; and a button mounted through the hole of the housing and mounted on the projected portion of the pressing frame.

2. The single pushbutton device as claimed in claim 1, wherein the rotary assembly has:

a driving pawl mounted between the pressing frame and the ratchet; and a stop pawl mounted between the ratchet and the housing.

3. The single pushbutton device as claimed in claim 2, wherein, when the rotary sleeve is rotated, the bump of the rotary sleeve is selectively connected with the noses of the abutting inserts.

4. The single pushbutton device as claimed in claim 1, wherein multiple second springs are mounted between the pressing frame and the housing.

5. The single pushbutton device as claimed in claim 1, wherein the bushing has multiple waterways formed through the bushing and communicating with corresponding recesses of the water tube to output water with multiple spray patterns through the waterways of the bushing.

* * * * *